US005409358A

United States Patent [19]

Song

[11] Patent Number: 5,409,358

[45] Date of Patent: Apr. 25, 1995

[54] LUBRICANT SUPPPLYING SYSTEM OF A HERMETIC COMPRESSOR

[75] Inventor: Choi Song, Seoul, Rep. of Korea

[73] Assignee: Goldstar Co., Ltd., Seoul, Rep. of Korea

[21] Appl. No.: 99,383

[22] Filed: Jul. 30, 1993

[30] Foreign Application Priority Data

Jul. 30, 1992 [KR] Rep. of Korea ..... 1992-14236

[51] Int. Cl.[6] ..... F04C 18/356; F04C 29/02

[52] U.S. Cl. ..... 418/63; 418/88; 418/94; 418/188

[58] Field of Search ..... 418/63, 88, 94, 188; 184/6, 18

[56] References Cited

U.S. PATENT DOCUMENTS 3,082,937 3/1963 Tucker ..... 418/88
3,184,157 5/1965 Galin ..... 418/88

FOREIGN PATENT DOCUMENTS 4171293 6/1992 Japan ..... 418/88
2195401 4/1988 United Kingdom ..... 418/88

*Primary Examiner*—John J. Vrablik
*Attorney, Agent, or Firm*—Morgan & Finnegan

[57] ABSTRACT

A hermetic compressor for compressing the refrigerant in such a refrigerating systems as in refrigerators, freezers, air conditioners and the like, has a sliding part slidably inserted in one end of a hollow shaft, the hollow shaft is adapted to have a tantgential contact with a pumping cylinder, wherein the rotation of the sliding part according to the rotation of the shaft while the sliding part maintains contact with inside of the pumping cylinder allows to draw in and push out oil inside of the cylinder through a lubrication oil guide, the hollow of the shaft and discharge holes on the shaft to feed to each lubrication parts.

15 Claims, 2 Drawing Sheets

LUBRICANT SUPPPLYING SYSTEM OF A HERMETIC COMPRESSOR

FIELD OF THE INVENTION

This invention relates to a hermetic compressor for compressing the refrigerant in such a refrigerating systems as in refrigerators, freezers, air conditioners and the like, and more particularly to a lubrication arrangement for such a compressor.

BACKGROUND OF THE INVENTION

As shown in FIG. 1, a conventional rotary type hermetic compressor includes a housing 1 containing a motor part having a stator and a rotor, a compression part for compressing refrigerant and a lubrication oil pumping part.

Of the motor part, the stator 4 is secured to the housing and the rotor 3 has a shaft 2 with a hollow.

The shaft 2 is journalled by a main bearing 7 and an auxiliary bearing 8 and the compression part thereof is positioned eccentric to the rotating axis of the shaft in a certain amount.

The compression part is located between the main bearing 7 and the auxiliary bearing 8. This compression part includes, as shown in FIG. 2, a cylinder having a refrigerant suction hole 11 formed at an angle with a refrigerant discharge hole formed therein, a roller 10 surrounding the eccentric part of the cylinder and a vane 15 slidably inserted between the suction hole and the discharge hole.

The vane 15 is adapted to maintain contact with the roller by a spring 16.

Accordingly, as shown in FIG. 2, the contact of the roller 10 with the vane and inside of the cylinder provides two enclosed spaces A and B. Of the two spaces A and B, the space in communication with the suction hole 11 is a suction chamber and the space in communication with the discharge hole is a compression chamber.

The compression process of refrigerant for above described construction is explained hereinafter.

Assuming that the rotor 3 rotates in clockwise direction on power supply to the motor part, the shaft secured to the rotor rotates in the same direction. In this time, as the roller surrounding the shaft moves together with the shaft, the contact point of the roller also moves in clockwise direction according to the rotation of the shaft.

By the consequence, as the space A becomes smaller, the refrigerant in the space A becomes compressed more and more.

If the pressure in the space A becomes higher above a preset level following the compression of the refrigerant in the space A, a valve 14 is opened to discharge compressed refrigerant gas.

Each component of the compression part of such a compressor should be finish machined to an extremely close tolerance so as to prevent leakage of refrigerant and therby to achieve a high efficiency of the compressor. To maintain high degree of finish, adequate lubrications on the moving components are required. Further, it is important that the moving components of the compressor are adequately lubricated so as to maintain the dynamic friction to a low level and minimize the friction loss. Finally, sufficient lubrication can minimize heat from friction loss permitting reduction of heat transfer and improvement of compressor efficiency.

Many types of lubrication arrangements are provided in conventional rotary type hermetic compressors.

Generally, the lubrication part of a conventional compressor has such a construction that a hollow shaft is submerged in an oil sump containing lubrication oil therein. The high pressure of refrigerant gas in the sealed housing or the rotating force of a propeller inserted in the hollow of the shaft pumps up lubrication oil in the oil sump through the hollow in the shaft to be sprayed from pumping oil discharge holes 2c formed on the circumference of the shaft to lubrication parts.

Lubrication oil, thus sprayed, drips down after lubrication and collected to the oil sump by gravity.

A few examples of conventional lubrication arrangements using gravity distribution is shown in U.S. Pat. Nos. 4,640,669 and 3,082,937.

In conventional hermetic compressor lubrication arrangements, the compression of gas is carried out at a pressure above 20–30 bars which is discharged out of the sealed housing through a discharge pipe after filling up the sealed housing as well as the oil sump in the lower part of housing.

Though there has been no problem in normal operations of oil lubrication due to the high gas pressure of above 20–30 bars in the oil sump which will carry out the pumping operation without any problem but in case when the back pressure on the lubricating oil in the oil sump is lower than the pressure in the compression chamber, for example when the high pressure is discharged directly through the discharge pipe without filling the housing, the oil pumping can not be carried out easily.

Accordingly, it has been a problem that lubrication in every lubrication part can hardly be expected because lubrication oil can not be reached to every lubrication part without fail and adequate oil can not be delivered to lubrication part because lubrication oil is not delivered under pressure.

And there is the problem of harmful vibration in a hermetic compressor described above caused by the eccentric part in the compression part of the shaft when the shaft rotates in high speed. To solve this problem, conventional compressors have been provided with another eccentric part in one end of the shaft.

SUMMARY OF THE INVENTION

The object of this invention is to provide a lubrication arrangement of a hermetic compressor capable of delivering sufficient oil under pressure any time.

These and other objects are achieved by providing a sliding part slidably inserted in one end of a hollow shaft, the hollow shaft is adapted to have a tantgential contact with a pumping cylinder, wherein the rotation of the sliding part according to the rotation of the shaft while the sliding part maintains contact with inside of the pumping cylinder allows to draw in and push out oil inside of the cylinder through a lubrication oil guide, the hollow of the shaft and discharge holes on the shaft to feed to each lubrication parts.

DETAILED DESCRIPTION OF THE INVENTION

Figure 1:
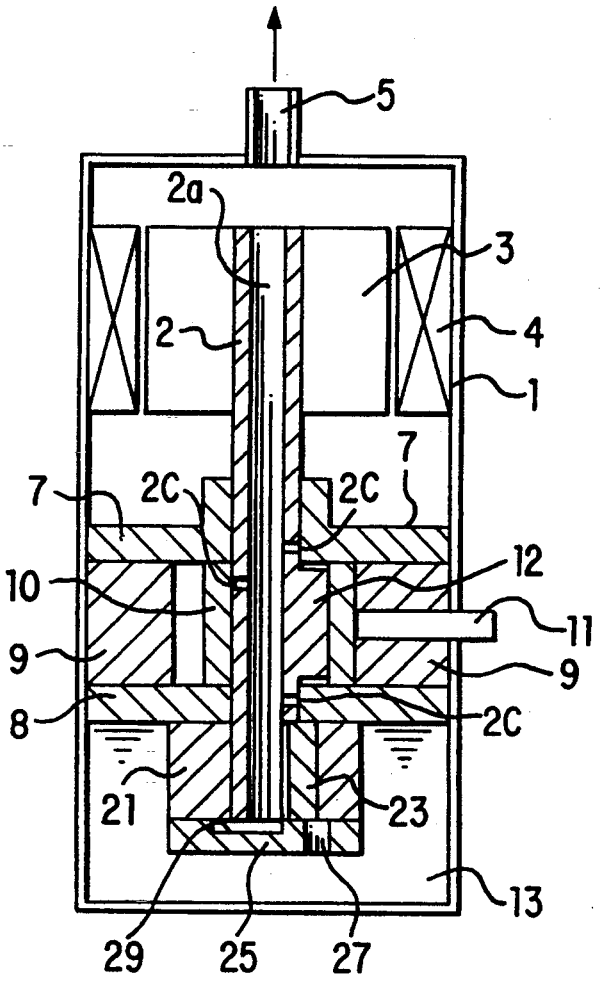
FIG. 1 shows a section of a compressor of this invention

Shown in FIG. 1 is a rotary type hermetic compressor of this invention, wherein the construction and the compression movements thereon is almost same with a conventional rotary type hermetic compressor. In this regard, the description for this invention is to be focused on lubrication arrangement hereinafter.

Figure 3:
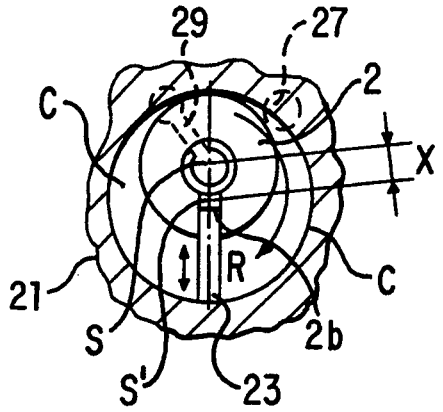
FIG. 3 shows a section of an oil pumping part of the compressor according to this invention.
Figure 4:
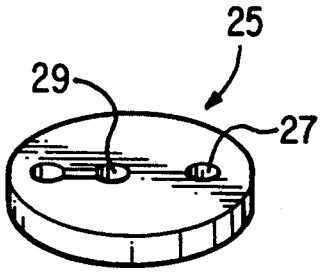
FIG. 4 is a perspective view of a bottom plate of an oil pump of the compressor according to this invention.
Figure 5:
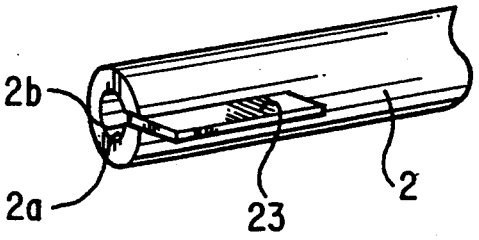
FIG. 5 is an assembled perspective view of a sliding plate of the compressor according to this invention.

According to FIG. 3, at the bottom of the crankshaft 2, an oil pump bottom plate 25 is secured having an oil discharge slot 29 in communication with a hollow 2*a* of the crankshaft 2. An oil pump cylinder 21 is positioned between the auxiliary bearing 8 and an oil pump bottom plate 25.

A radial slot 2*b* is provided in the crankshaft 2 in a position where the oil pump cylinder located in a length corresponding to the depth of oil cylinder, where a sliding plate 23 is slidably inserted having a corresponding size with the slot.

According to FIG. 3, as the crankshaft 2 rotates in clockwise direction, the sliding plate 23, moved radially and pushed against the inside wall of the oil pump cylinder 21 by the centrifugal force, rotate in the same direction with the crankshaft 2.

The oil pump bottom plate 25 has an oil suction hole 27 connecting the oil pump cylinder 21 with an oil sump 13 below.

Figure 1A:
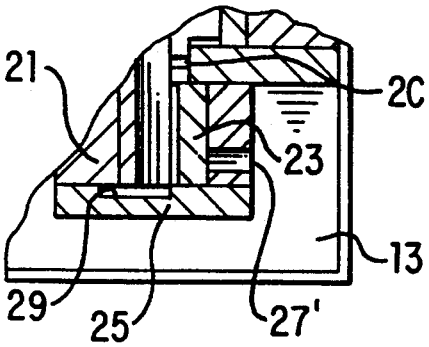
FIG. 1A is a modification of a portion of the compressor shown in FIG. 1.

The oil suction hole 27′ may be provided on the wall of the oil pump cylinder 21 as shown in FIG. 1A.

As shown in FIG. 3, there is an eccentricity of X between the rotating axis S of the crankshaft 2 and the center S′ of the oil pump cylinder 21.

In FIG. 1 and FIG. 3, as the crank shaft 2 rotates in clockwise direction, the sliding plate 23, moved radially and pushed against the inside wall of the oil pump cylinder 21 by the centrifugal force, rotates in the same direction with the crankshaft 2, thereby oil in the oil sump is drawn into the cylinder 21 through the oil suction hole 27 in the oil pump bottom plate 25.

As the sliding plate 23 rotates further, a pumping volume C enclosed by the crankshaft 2, the sliding plate 23 and the oil pump cylinder 21 become smaller and oil, thus pushed by the rotation in the pumping volume C, is pumped out from inside of the oil pump cylinder 21 to the hollow 2*a* of the crankshaft 2 through the oil dischange slot 29 in the oil pump bottom plate 25. Then the oil, flowing along the hollow 2*a*, is distributed to feed to lubrication parts through a pumping oil discharge hole 2*c* in communication with the hollow 2*a* by the centrifugal force.

Figure 2:
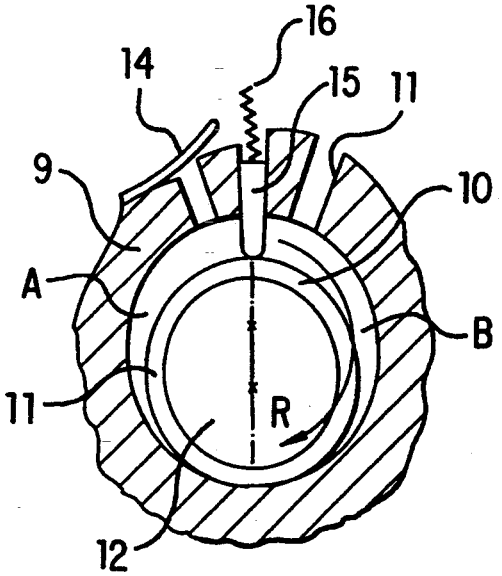
FIG. 2 shows a section of a compression chamber of the compressor according to this invention.

In FIG. 2 and FIG. 3, for the relative positioning of the sliding plate 23 to the vane 15 to match the timing of the oil pumping of the oil pump cylinder with the compression of gas in the compression cylinder, assuming that the compression of gas begins at an angle R=0 degree, where R is the angle from the vane 15 to the abutting point of the roller 10 against the wall of the compression cylinder 9 and where R′ is the angle from the abutting point of the crankshaft 2 against the oil pump cylinder 21 to the sliding plate 23, the angle R′ has to be positioned at O when the R=0 degree.

Figure 6A:
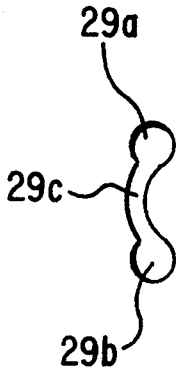
FIGs. 6 (A) (B) (C) show various oil discharging slots of the compressor according to this invention.
Figure 6B:
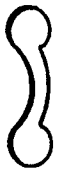
Figure 6C:
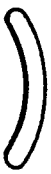
Figure 7:
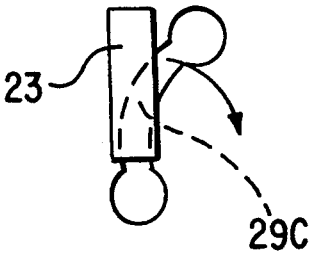
FIG. 7 shows an intersection of a sliding plate with an oil discharge slot of the compressor according to this invention.

As shown in FIGS. 6(A)(B)(C), the shape of the oil discharge slots 29 of the oil pump bottom plate 25 can vary. These can be either curved slots 29*c* having two circular slots 29*a*, 29*b* at both ends thereof, one slot 29*a* being within the surface of oil pump cylinder and the other slot 29*b* being matched with the opening of the hollow 2*a* of the crankshaft 2 as shown in FIGS. 6(A),(B) or only a simple curved slot 29*c* as shown in FIG. 6(C) or, though not illustrated, only a simple straight slot. Further the relative arrangement of the slots 29*c* with respect to the sliding plate 23 has to be such that the matching area of the sliding plate 23 with the slot 29*c* has to be minimum when the sliding plate 23 sliding over the slot 29*c*.

It is preferable to form the width of the slot 29*c* narrower than the thickness of the sliding plate 23 to ensure smooth pass of the sliding plate 23 over the slot 29*c* during rotation of the sliding plate 23.

Meantime, though the embodiments of this invention has been described based on a vertical type rotary compressor, this invention can also be applied to a horizontal type rotary compressor by providing an oil pipe leading oil in lower position to an oil suction area.

And this invention can be applicable not only to rotary type compressors but also to such a compressors as reciprocating type and scroll type.

According to this invention as explained above, sufficient oil lubrication can be achieved by an oil pump pumping oil from an oil sump and delivering it through a crankshaft. As a result, even the lubrication part of a low pressure chamber type compressor in which compressed gas is directly discharged from a compression chamber to out side of a housing, also can be fed with sufficient oil and to every part of the lubrication part without fail.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A system for supplying lubricant from an oil sump to moving components of a hermetic compressor comprising:

a hollow shaft having a slot and a plurality of pumping oil discharge holes formed on the circumference of the hollow shaft, said holes being in communication with the center of the hollow shaft;

a pumping cylinder having an inner diameter in a plane perpendicular to said hollow shaft; said inner diameter being eccentric to said hollow shaft, and a portion thereof making tangential contact with said hollow shaft, the pump diameter of said pumping cylinder being larger than the shaft diameter of the hollow shaft;

a bottom plate abutting with lower ends of the hollow shaft and said pumping cylinder, said bottom plate having a lubrication oil guiding slot formed in a radial shape and communicating with the hollow shaft and said pumping cylinder, said lubrication oil guiding slot comprising first and second circular slots and a curved slot communicating with said first and second circular slots;

means forming a suction hole for drawing in oil from the oil sump to said pumping cylinder therethrough; and a sliding part slidably inserted in the slot formed in the hollow shaft and located within said pumping cylinder, said sliding part being rotated with a rotation of the hollow shaft while maintaining contact with the inside of said pumping cylinder, said sliding part drawing in the oil through the suction hole forming means and pumping out the drawn oil through the guiding slot and the hollow shaft;

wherein the plurality of pumping oil discharge holes supply the oil to the moving compressor components by the rotation of the hollow shaft and said sliding part.

2. A system claimed in claim 1, wherein said first and second circular slots include first and second diameters, respectively, and said curved slot includes a width, and wherein the first and second diameters are greater than the width.

3. A hermetic compressor having moving components lubricated via an oil sump comprising:

a sealed housing;

a motor part secured to the housing and transmitting rotating power to a hollow shaft;

an upper bearing and a lower bearing rotatably journalling said hollow shaft;

a compression part, including said hollow shaft, compressing refrigerant by the rotating power transmitted thereto;

a lubrication oil pumping part comprising:

said hollow shaft having a slot and a plurality of pumping oil discharge holes formed on the circumference of the hollow shaft, said holes being in communication with the center of the hollow shaft;

a pumping cylinder having an inner diameter in a plane perpendicular to said hollow shaft; said inner diameter being positioned eccentric to said hollow shaft, and a portion thereof making tangential contact with the hollow shaft, the pump diameter of said pumping cylinder being larger than the shaft diameter of the hollow shaft;

a bottom plate abutting with lower ends of the hollow shaft and said pumping cylinder, said bottom plate having a lubrication oil guiding slot formed in a radial direction and communicating with the hollow shaft and said pumping cylinder, said lubrication oil guiding slot comprising first and second circular slots and a curved slot communicating with said first and second circular slots;

means forming a suction hole for drawing in oil from the oil sump to said pumping cylinder therethrough; and a sliding part slidably inserted in the slot formed in the hollow shaft and located within said pumping cylinder, said sliding part being rotated with a rotation of the hollow shaft while maintaining contact with the inside of said pumping cylinder, said sliding part drawing in the oil through the suction hole forming means and pumping out the drawn oil through the guiding slot and the hollow shaft;

wherein the plurality of pumping oil discharge holes supply the oil to the moving compressor components by the rotation of the hollow shaft and said sliding part.

4. A hermetic compressor as claimed in claim 3, wherein said suction hole forming means is in said pumping cylinder.

5. A hermetic compressor as claimed in claim 3, wherein said suction hole forming means is in said bottom plate.

6. A hermetic compressor as claimed in claim 3, wherein said first and second circular slots include first and second diameters, respectively and said curbed slot includes a width, and wherein the first and second diameters are greater than the width.

7. A hermetic compressor as claimed in claim 3, wherein said lubrication oil guiding slot is formed in said bottom plate in a radial direction.

8. A hermetic compressor as claimed in claim 7, wherein the width of the lubrication oil guiding slot is narrower than the thickness of the sliding part.

9. A rotary type hermetic compressor having moving components, lubricated via an oil sump, comprising:

a sealed housing;

a motor part secured to the housing;

said motor part transmitting rotating power to a hollow shaft;

an upper bearing and a lower bearing rotatably journalling said hollow shaft;

a compression part, including said hollow shaft, compressing refrigerant by the rotating power transmitted thereto, comprising:

a compression cylinder having means forming a refrigerant suction hole for drawing in refrigerant therethrough, means forming a. refrigerant discharge hole for discharging refrigerant therethrough, and a vane positioned between said refrigerant suction hole forming means and the discharge hole forming means and elastically pressed by a spring thereon;

an eccentric part formed on said hollow shaft; and a roller surrounding the eccentric part and adapted to maintain a linear contact with the vane and inside of the cylinder tangentially, wherein the movement of tangential linear contact with inside of the cylinder to the direction of rotation of said hollow shaft according to the rotation of said hollow shaft allows to draw in refrigerant gas and to discharge the drawn in refrigerant gas;

a lubrication oil pumping part comprising:

said hollow shaft having a slot and a plurality of pumping oil discharge holes formed on the circumference of said hollow shaft and being in communication with the center of said hollow shaft;

a pumping cylinder having an inner diameter in a plane perpendicular to said hollow shaft; said inner diameter being positioned eccentric to said hollow shaft, and a portion thereof making tangential contact with said hollow shaft, the pump diameter of said pumping cylinder being larger than the shaft diameter of said hollow shaft;

a bottom plate, abutting with lower ends of said hollow shaft and said pumping cylinder, said bottom plate having a lubrication oil guiding slot formed in a radial direction and communicating with said hollow shaft and said pumping cylinder, said lubrication oil guiding slot comprising first and second circular slots and a curved slot communicating with said first and second circular slots;

means forming a suction hole for drawing in oil from the oil sump to said pumping cylinder therethrough; and a sliding part slidable inserted in the slot formed in said hollow shaft and located within said pumping cylinder, said sliding part being rotated with a rotation of said hollow shaft while maintaining contact with the inside of said pumping cylinder, said sliding part drawing in the oil through the suction hole forming means and pumping out the drawn oil through the guiding slot and said hollow shaft;

wherein the plurality of pumping oil discharge holes supply the oil to the moving compressor components by the rotation of said hollow shaft and said sliding part.

10. A rotary type hermetic compressor as claimed in claim 9, wherein said suction hole forming means is in said pumping cylinder.

11. A rotary type hermetic compressor as claimed in claim 9, wherein said suction hole forming means is in said bottom plate.

12. A rotary type hermetic compressor as claimed in claim 9, wherein the position of the vane relative to the sliding part is such that, when the length of the vane inside of the compression cylinder is minimum, the length of the sliding part in the pumping cylinder is also minimum.

13. A rotary type hermetic compressor as claimed in claim 9, wherein said first and second circular slots include first and second diameters, respectively and said curved slot includes a width, and wherein the first and second diameters are greater than the width.

14. A hermetic compressor as claimed in claim 9, wherein said lubrication oil guiding slot is formed in said bottom plate in a radial direction.

15. A rotary type hermetic compressor as claimed in claim 14, wherein the width of the lubrication oil guiding slot is narrower than the thickness of the sliding part.

* * * * *